US005483742A

United States Patent [19]

Dunyak, Jr.

[11] Patent Number: 5,483,742

[45] Date of Patent: Jan. 16, 1996

[54] TOOL FOR INSTALLING A U-SHAPED RETAINER CLIP ON A CONNECTOR AND A METHOD THEREOF

[76] Inventor: Andrew J. Dunyak, Jr., 2512 Forest Haven Blvd., Edison, N.J. 08817

[21] Appl. No.: 366,969

[22] Filed: Dec. 30, 1994

[51] Int. Cl.[6] ..... H01R 43/00

[52] U.S. Cl. ..... 29/881; 29/758; 29/747; 29/243.56; 29/270

[58] Field of Search ..... 29/881, 755, 225, 29/243.56, 270, 509, 235, 758, 747; 439/347

[56] References Cited

U.S. PATENT DOCUMENTS 4,380,118 4/1983 Driver et al. ..... 29/881 X 4,635,355 1/1987 Brinkman et al. ..... 29/881 X 5,207,593 5/1993 Bogiel ..... 439/347 X

*Primary Examiner*—Peter Vo

*Assistant Examiner*—Khan V. Nguyen

*Attorney, Agent, or Firm*—Ezra Sutton

[57] ABSTRACT

The invention provides a tool having a handle and a hollow tool section having spaced-apart metal prongs mounted therein. The outer walls of the hollow tool section are adapted to engage the inner walls of the connector, and the metal prongs are adapted to enter the electrical sockets of the connector so as to allow the U-shaped retainer clip to be installed on the outer walls of the connector in a simple and easy manner.

5 Claims, 2 Drawing Sheets

TOOL FOR INSTALLING A U- SHAPED RETAINER CLIP ON A CONNECTOR AND A METHOD THEREOF

FIELD OF THE INVENTION

The present invention relates to a tool for installing a U-shaped retainer clip on a connector for a fuel injector or sensor or the like.

BACKGROUND OF THE INVENTION

The prior art does not provide for a tool for installing a retainer clip on a connector for a fuel injector or sensor or the like.

It is an object of the present invention to provide a simple and inexpensive tool for installing a retainer clip on such a connector. It may be used by auto mechanics or consumers who work on their vehicles.

SUMMARY OF THE INVENTION

In accordance with the principles of the present invention, there is provided a tool for installing a U-shaped retainer clip on a connector for a fuel injector or a sensor or the like. The tool includes a circular-shaped handle, a rectangular-shaped hollow tool section having outer walls connected to the handle, a pair of spaced-apart prongs mounted inside the hollow tool section, and the outer walls of the hollow tool section adapted to engage the inner walls of the connector and the prongs adapted to enter the electrical sockets of the connector so as to allow the U-shaped retainer clip to be easily and quickly installed on the outer walls of the connector.

BRIEF DESCRIPTION OF THE DRAWINGS

Further objects, features, and advantages of the present invention will become apparent upon consideration of the detailed description of the presently-preferred embodiment, when taken in conjunction with the accompanying drawings, wherein.

DESCRIPTION OF THE PREFERRED EMBODIMENT

Figure 1:
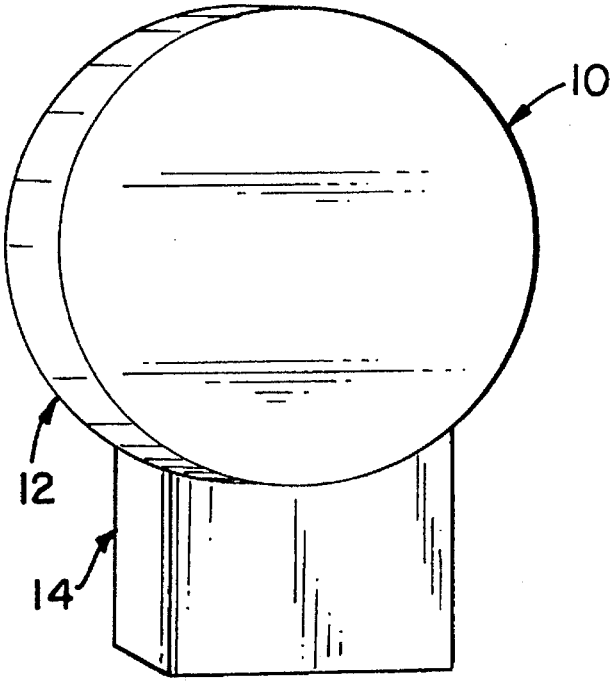
FIG. 1 is a perspective view of the tool of the present invention.
Figure 4:
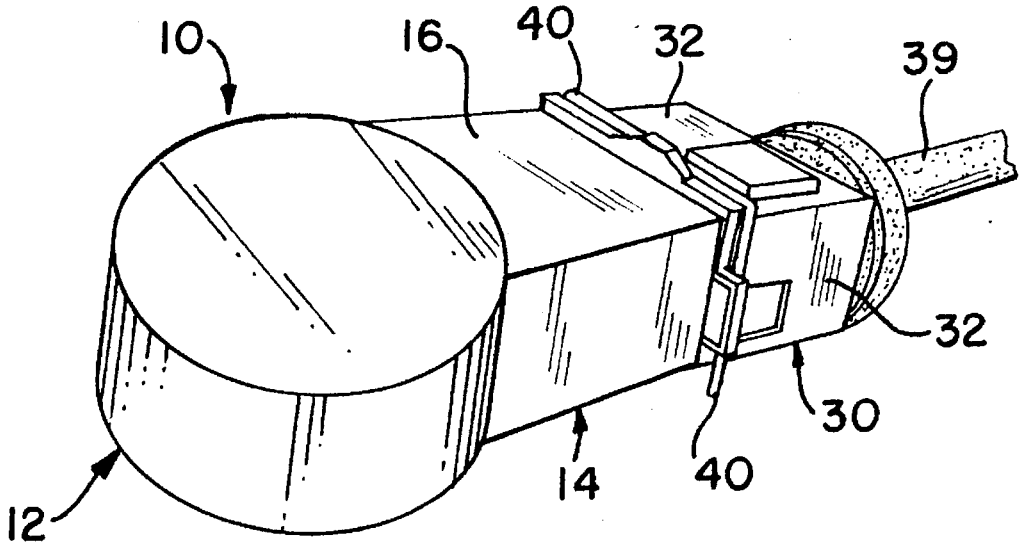
FIG. 4 shows the tool in a perspective view with the tool inserted into the connector and the retainer clip in place on the outer walls of the connector.

Referring to FIGS. 1 and 4, there is shown the tool 10 of the present invention having a circular-shaped handle 12, a rectangular-shaped hollow section 14 having outer walls 16, outer sidewalls 16*a* and 16*b*, inner walls 18, and a pair of spaced-apart metal prongs 20 and 22 mounted inside the hollow section 14 on a rear wall 24 thereof. Metal prongs 20 and 22 are not connected to each other and are independent and are embedded in the rear wall 24 formed of plastic. Handle 12 and hollow section 14 are integrally formed as a unit and are formed of plastic material.

Figure 2:
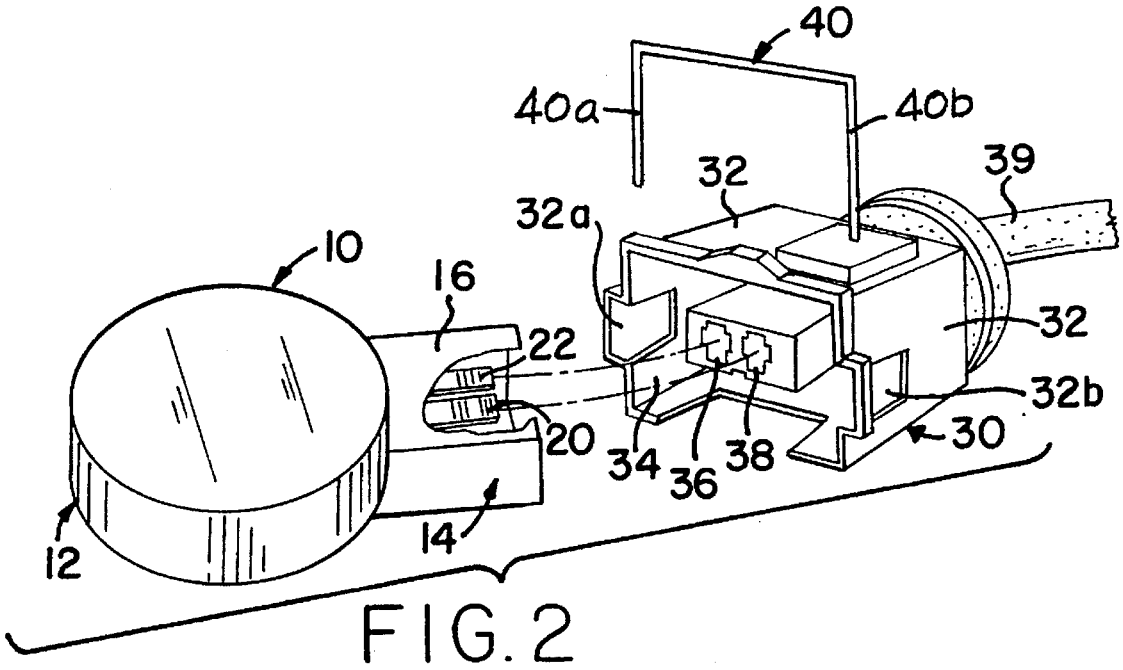
FIG. 2 shows the tool in a partial cutaway perspective view showing the tool being inserted into the connector followed by the retainer clip being attached to the connector.
Figure 3:
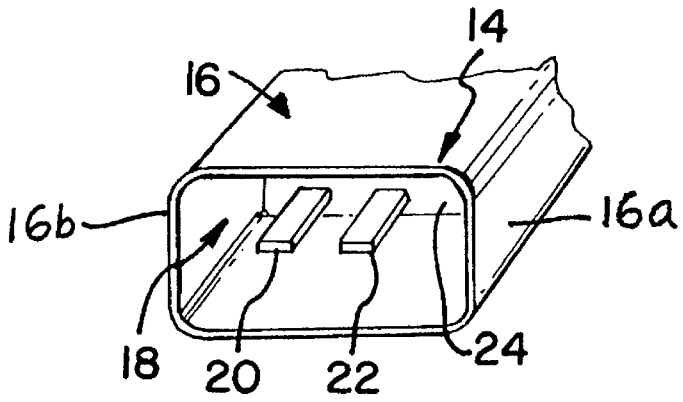
FIG. 3 shows an end view of the tool in partial perspective.

A connector 30 is shown in FIG. 2 having outer walls 32, inner sidewalls 34, electrical sockets 36 and 38 mounted therein, a wire 39 connected to the connector 30 and sockets 36 and 38, and openings 32*a* and 32*b* in inner sidewalls 34.

The outer sidewalls 16*a* and 16*b* of the hollow tool section 14 are adapted to enter connector 30 and engage the inner sidewalls 34 of connector 30 to block off openings 32*a* and 32*b*. This is done before the U-shaped retainer clip 40 is installed, so that when U-shaped clip 40 is installed, the two side legs 40*a* and 40*b* of U-shaped clip 40 cannot enter the inside cavity of connector 30 through openings 32*a* or 32*b* which have been blocked off. The metal prongs 20 and 22 also enter the electrical sockets 36 and 38, respectively, of connector 30 to provide rigidity to the connecting components.

After tool 14 has been inserted within connector 30, as shown in FIG. 2, then the U-shaped retainer clip 40 is installed on the outer walls 32 of connector 30 by sliding it into position on walls 32. As clip 40 is pushed into position on connector 30, the two side legs 40*a* and 40*b* of clip 40 are prevented from entering openings 32*a* and 32*b* because these openings have been blocked off by outer sidewalls 16*a* and 16*b* of tool 10. Thus, clip 40 is guided into proper alignment with outer walls 32.

FIG. 4 shows U-shaped retainer clip 40 fully installed on the outer walls 32 of connector 30. Thereafter, tool 10 is removed from connector 30, and sockets 36 and 38 are then ready to be connected to a fuel injector, sensor, or other device.

Retainer clips 40 are used on temperature sensors, oxygen sensors, auxiliary air regulators, cold start valves, anti-knock sensors, anti-lock sensors, and in electronic-controlled transmissions. Although these retainer clips 40 have slightly varied configurations, tool 10 of the present invention can be used for all of these varied configurations.

The tool 10 of the present invention also cleans and straightens the connector sockets 36 and 38 when the metal prongs 20 and 22 are inserted into sockets 36 and 38.

Except for metal prongs 20 and 22, the tool 10 is formed of any suitable plastic material, and handle 12 can be of any desired shape.

Although the present invention has been shown with the tool having one pair of metal prongs 20 and 22, it should be understood that the tool may include multiple pairs of metal prongs 20 and 22, to be used on connectors having multiple pairs of electrical sockets 36 and 38.

In accordance with the present invention, there has been provided a simple, easy to use, and inexpensive tool for installing a U-shaped retainer clip on a fuel injector, sensor, or the like.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A tool for installing a U-shaped retainer clip on a connector for a fuel injector or a sensor, said connector having electrical sockets for connection to an electrical wire, and having inner sidewalls and outer sidewalls, and openings formed in said inner and outer sidewalls, and said U-shaped retainer clip having two side legs, said tool comprising:

a) a handle;

b) a rectangular-shaped hollow tool section having outer sidewalls connected to said handle and a rear wall formed of plastic connected to said handle;

c) at least one pair of spaced-apart metal prongs mounted on the rear wall of said hollow tool section; and d) the outer sidewalls of said hollow tool section are adapted to be inserted within the connector so that said outer sidewalls of said hollow tool section engage the inner sidewalls of the connector and said metal prongs are adapted to enter the electrical sockets of said connector, so that said openings in said inner sidewalls of the connector are blocked off so as to prevent said two side legs of said U-shaped retainer clip from entering said openings, so that said U-shaped retainer clip is fully seated on the outer sidewalls of said connector and so that the side legs of said U-shaped retainer clip are engaged with the outer sidewalls of the connector.

2. A tool in accordance with claim 1, wherein said tool is formed of plastic.

3. A tool in accordance with claim 1, wherein said handle is circular in shape.

4. A tool in accordance with claim 1, wherein said handle and said hollow tool section are integrally formed as a unit and are formed of plastic material.

5. A method of using a tool for installing a U-shaped retainer clip on a connector for a fuel injector or a sensor, said connector having electrical sockets for connection to an electrical wire, and having inner sidewalls and outer sidewalls, and openings formed in said inner and outer sidewalls, and said U-shaped retainer clip having two side legs, and said tool having a handle, a rectangular-shaped hollow tool section having outer sidewalls connected to said handle and a rear wall formed of plastic connected to said handle, at least one pair of spaced-apart metal prongs mounted on the rear wall of said hollow tool section, said method comprising the steps of:

a) inserting said hollow tool section into said connector so that said outer sidewalls of said hollow tool section engage the inner sidewalls of said connector and close said openings and so that said metal prongs enter said electrical sockets;

b) installing said U-shaped retainer clip on said outer walls of said connector so that the two side legs of said U-shaped retainer clip engage the outer sidewalls of said connector and move pass over without entering the openings; and c) removing said hollow tool section from said connector.

* * * * *